United States Patent [19]

Sioufy

[11] 3,946,448

[45] Mar. 30, 1976

[54] APPARATUS FOR DISINFECTION AND CHEMICAL PURIFICATION OF TOILET BOWLS

[75] Inventor: Tamim El Sioufy, Saarbruecken, Germany

[73] Assignee: MEKOPHARMA Dr. Becker & Cie. K.G., Saarbruecken, Germany

[22] Filed: Nov. 4, 1974

[21] Appl. No.: 520,942

[30] Foreign Application Priority Data

Nov. 2, 1973 Germany ..... 2355054
Oct. 17, 1974 Germany ..... 2450197

[52] U.S. Cl. ..... 4/223; 4/224; 4/231; 4/232

[51] Int. Cl.[2] ..... E03D 9/02

[58] Field of Search ..... 4/223, 231, 232, 228, 232, 4/222

[56] References Cited

UNITED STATES PATENTS 1,293,407 2/1919 Goodhue ..... 4/223
3,316,559 5/1967 Ewing et al. ..... 4/223
3,778,849 12/1973 Foley ..... 4/228

FOREIGN PATENTS OR APPLICATIONS 522,056 6/1940 United Kingdom ..... 4/224

*Primary Examiner*—Henry K. Artis
*Attorney, Agent, or Firm*—Erich M. H. Radde

[57] ABSTRACT

Apparatus for disinfection and chemical purification of toilet bowls, comprising a storage container spaced from the bowl and containing a purifying and disinfecting liquid, and a valve capsule mounted in the cavity of the bowl edge near the water inlet opening of the bowl. The valve capsule is provided with a check valve and a flap actuated by the flush flow so as to open the check valve under the pressure of the flush flow. Fluid conveying means is provided for feeding the disinfecting and purifying liquid to the valve capsule from the storage container.

12 Claims, 3 Drawing Figures

APPARATUS FOR DISINFECTION AND CHEMICAL PURIFICATION OF TOILET BOWLS

BACKGROUND OF THE INVENTION

The present invention relates as indicated to an apparatus for disinfection and chemical purification of toilet bowls.

Toilet bowls have hitherto usually been disinfected and chemically purified by feeding a certain amount of a granular or liquid agent, intended specifically for purifying and disinfecting such toilet bowls, directly from bottles or other containers into the toilet bowls. This method of chemical purification and disinfection has the disadvantage that cleanliness and deodorization of the bowls can be achieved only by regular purification at intervals of a few hours. A person who continually carries out this purification must be available.

In order to overcome this disadvantage, another procedure proposed consisted in placing at the edge of the toilet bowls disinfecting and purifying agents in solid form which, when surrounded by the flush flow, dissolved at their surface and thus at each flushing, discharging materials into the toilet bowl. These suspended devices are not only of unsightly appearance but also obstruct the mechanical purification of the toilet bowls. These disinfecting lumps must be kept small, which leads to the result that the available quantities of disinfectants are too small to yield disinfectants for any substantial length of time. With progressive consumption of the disinfecting lump and thus diminishing surface, the amount of disinfectant discharged per flush becomes smaller and smaller, and therefore the disinfection becomes less and less sufficient. The suspended disinfecting devices are thus to be considered merely supplemental to manual purification and disinfection.

More than half a century ago it was proposed to introduce the disinfecting and purifying liquid directly into the flush water supply pipe from a device rigidly mounted thereto and consisting of a storage container with a valve. For opening the valve a small lever, one end of which protrudes into the feed pipe, is provided. To install this device, a special construction of the feed pipe, or at least the insertion of a pipe element with the device fastened thereto, was necessary. This proposal accordingly has not been used in practice since to alter the existing pipe lines would be very expensive. Even when such toilet installations were newly built, the device would have caused considerable additional expense. When repairs were required, abstention from using the toilet had to be taken into account as well as the repair expenses.

SUMMARY OF THE PRESENT INVENTION

The invention aims at producing an apparatus moderate in price by means of which disinfection and chemical purification of the toilet bowl without attendance is carried out for a considerable time, and causes no disturbance in the use of the toilet.

The solution provided by the invention is characterized in that the passage or outlet device consists of a valve capsule provided with a clamp strap which can be clamped in from the bottom into the cavity of the bowl edge near the intake of the bowl, the valve capsule having a flap actuated by the flush flow, which flap opens under such action the automatically closing check valve. The disinfecting and purifying liquid is fed from a storage container separated from the bowl and mounted at a suitable place, preferably at one of the room walls behind the bowl, through a thin hose to the valve capsule.

This embodiment of the invention entails the special advantage that, without alterations on the existing installation, the part to be fastened to the bowl, that is, the valve capsule, is entirely held in the cavity of the bowl edge and therefore impairs neither the looks nor the mechanical purification of the bowl.

Moreover, the invention provides that the lever or flap is constructed as a distributing element for holding and distributing the disinfecting and purifying liquid, in order to feed through this element and liquid preferably first to the inner wall of the bowl.

With this structure, it is advantageous to add foam-forming materials to the disinfecting and purifying liquid so as to promote the said distribution through the distributing flap and thus disinfection and purification. The foam formed moistens first the inner wall of the bowl as deodorizer and then comes to rest as a white cap floating on the surface of the water in the bowl.

The objects and advantages of the invention will become more readily apparent as the description proceeds in particular reference to the drawings.

BRIEF DESCRIPTION OF THE APPLICATION DRAWINGS

DETAILED DESCRIPTION OF THE PREFERRED EMBODIMENTS

Figure 1:
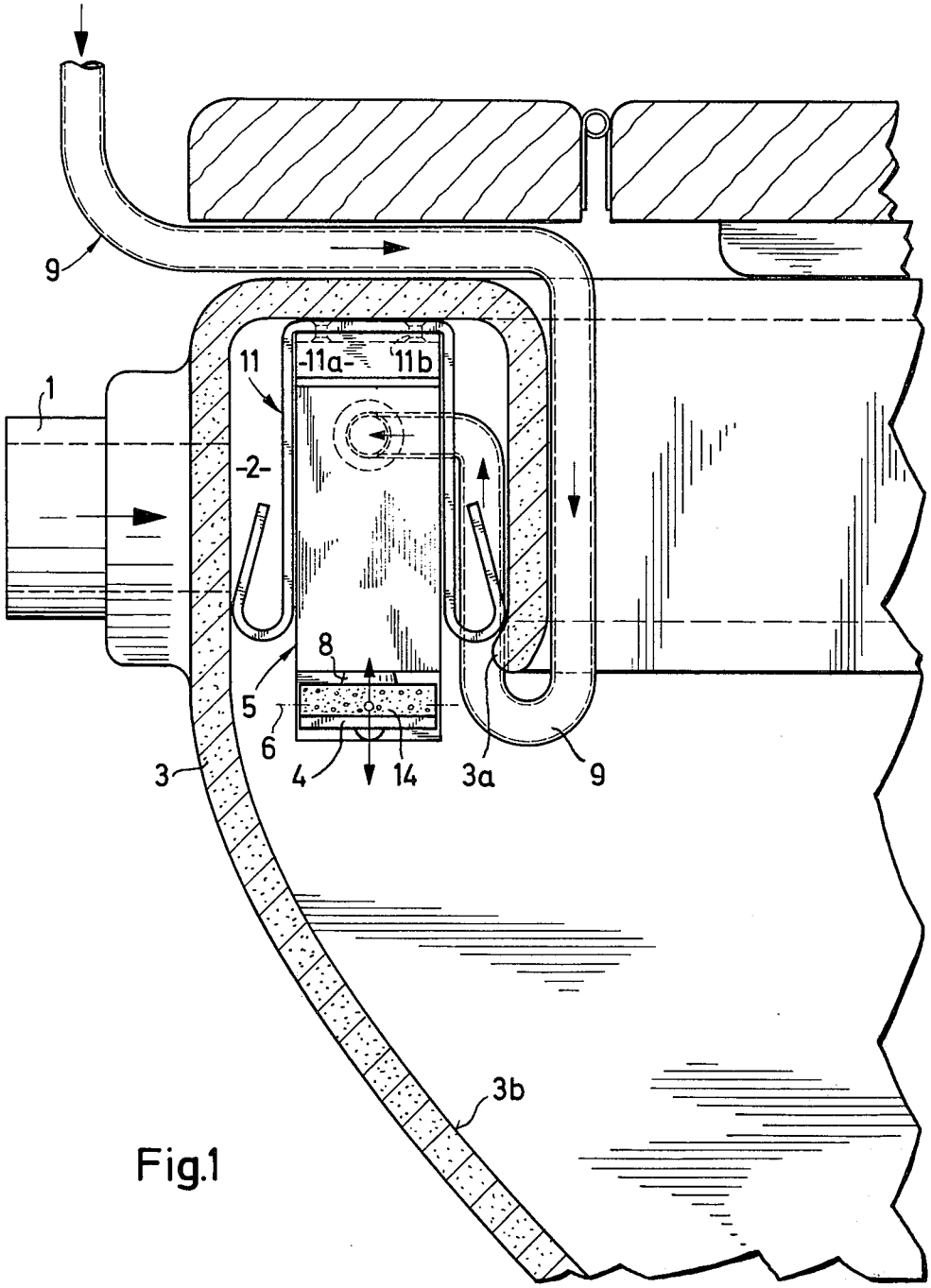
FIG. 1 is a vertical sectional view through the bowl edge, illustrating the connecting pipe for the water feed pipe and the inserted valve capsule, as well as the distributing flap to be actuated by the flush flow, all of which are shown in elevation.
Figure 2:
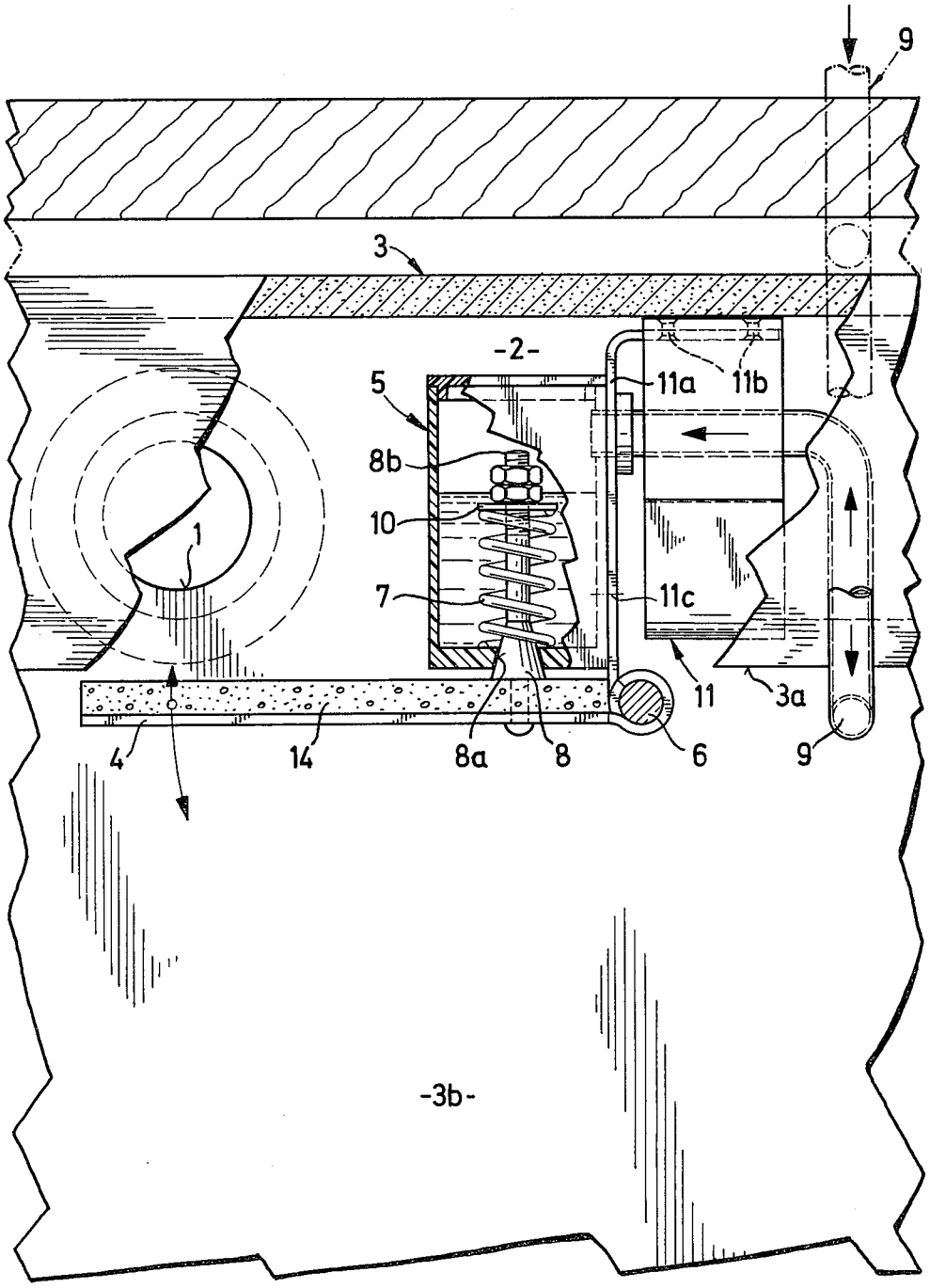
FIG. 2 is a partially fragmentary front view of the bowl edge, illustrating the valve capsule with the laid-open valve cone and valve spring, and the distributing flap.

When the flushing mechanism is actuated, the flushing water, flowing under pressure through the terminal pipe connection 1 for the water supply into the cavity 2 defined by the bowl edge 3, acts upon the left side, as viewed in FIG. 2, of the top surface of a distributing flap 4 which is thereby pivoted about a hinge 6 which is positioned at the right end of the distributing flap 4 and secured to the casing of a valve capsule 5. The downward pivoting movement of the flap 4 is against the bias of the spring pressure of valve spring 7 mounted in the valve capsule. In this process the valve cone 8, rigidly connected to the distributing flap 4, moves downward and therefore away from its seat in the bottom wall of the casing of valve capsule 5. When the valve cone 8 is unseated, purifying and disinfecting liquid is discharged through the valve opening, with the liquid being continuously fed, under light pressure, through a thin hose 9 communicating with the upper area of the valve capsule from the storage container (not shown), preferably arranged at a higher level for gravity flow of the liquid. As long as the flushing process continues, valve flap 4 remains in its bottom position thereby unseating the valve cone, and during this time disinfecting liquid is discharged from the opening of the valve capsule and is mixed, in uniform distribution, with the flushing water which surrounds this opening and which is under turbulence. When the flushing process is terminated and consequently the water pressure upon distributing flap 4 discontinued, valve cone 8 is biased upwardly by spring 7, the upper end of which engages a disc 10 positioned around the threaded shaft portion of the valve. Nuts are threadedly engaged around the shaft above the disc 10, with the spring pressure bearing upon the valve through such nuts. The seating of the valve cone 8 terminates the supply of purifying and disinfecting liquid to the bowl until a subsequent flushing operation.

A mounting spring member 11 envelops the casing of the valve capsule 5 from the top and is fixed to the cover thereof, with the bottom of the spring member resiliently engaging the opposed walls of the toilet bowl. The spring member 11 permits easy installation and removal of the apparatus and makes it possible, while the apparatus is sufficiently firmly fixed, to move it slightly to the side and back to its place for the purpose of cleansing the cavity of the bowl edge mechanically.

Figure 3:
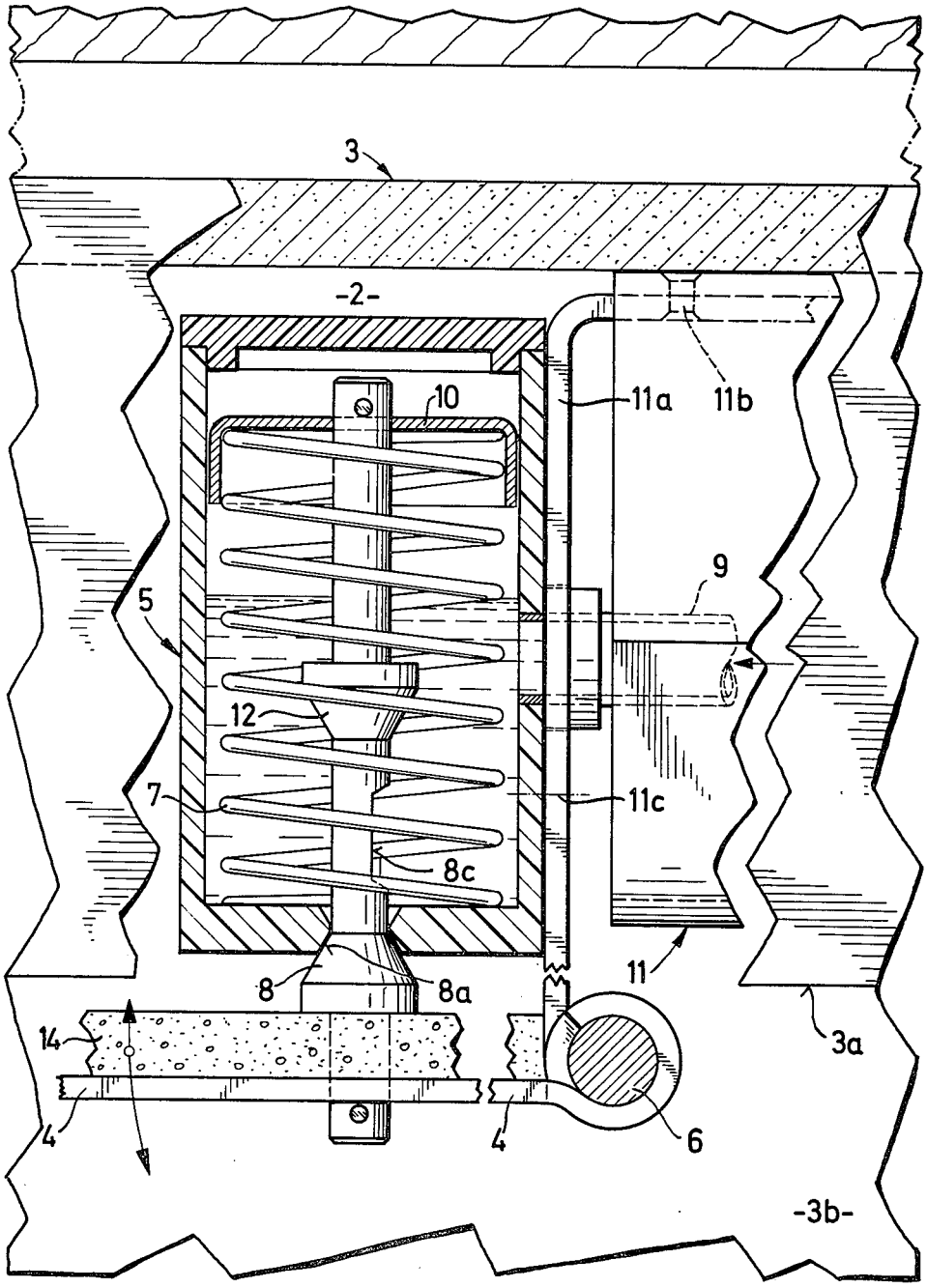
FIG. 3 is a partially fragmentary front view similar to FIG. 2, illustrating a modified form of a shaped valve capsule with two valve cones and the distributing flap.

FIG. 3 shows a modification of FIG. 2. In addition to valve cone 8, a second valve cone 12, facing in opposite direction, is spaced above valve cone 8 on the valve shaft. When distributing flap 4 is lowered in response to the flushing action as described, the descending movement of valve cone 8 at first opens the valve. However, disinfecting and purifying liquid is discharged only until upper valve cone 12 recloses the valve opening. This makes it possible to discharge a proportioned amount of liquid and thereafter to reclose the valve capsule. This results in the advantage that only the predetermined amount of liquid is discharged corresponding to the liquid required for one flushing process. When the flushing flow stops, the distributing or valve flap 4 moves upward again, valve cone 12 is unseated thereby permitting liquid flow from the capsule until the lower valve cone 8 is reseated.

The amount of liquid that is in each case discharged when the valve opens and until it closes again, is prespecified by the distance between the two valve cones 8 and 12. Hinge 6 about which distributing flap 4 is movable, may also be arranged at a suitable distance from the valve in order to achieve the best inclination possible.

Distributing flap 4 is provided with an upper surface particularly designed for holding the liquid and distributing it to the inner wall surface of the bowl. When the flap 4 is actuated by the flush flow as described it assumes a prespecified inclination, whereby the liquid discharged from the valve is distributed over the entire surface. For this purpose it is advantageous to shape the holding surface in a particular way, e.g. with grooves, so as to make the water that strikes it whirl and to atomize it, thus producing the foam formation of the foam materials added to the disinfecting and purifying liquid. The grooves or the like may particularly serve for directing in a controlled manner the liquid from the valve opening to the other end of the holding or distributing flap after the inclined position has been assumed. It is advantageous to impart to the holding surface an inclination in the direction to the bowl wall 3, in order to avoid that the flushing water, which strikes under pressure, spatters off in the opposite direction.

Instead of the aforementioned shaping of the holding surface or in addition thereto, the distributing flap may be provided with a sponge support 14 which is also useful for holding the renewed liquid amount when the flushing process has ended, in accordance with the FIG. 3 form of the invention. The grooves on the flap surface can in this case be particularly advantageous for directing the liquid and distributing it into the supported sponge. The sponge support may be kept wider than the distributing flap and abut in places to the inner wall of the bowl, or the distributing flap itself can be shaped in such a way that it abuts the wall at least in places.

Besides the hinge 6 which permits the opening and closing of the valve in a vertical direction, a second hinge, extending in a horizontal direction may be provided which serves to hinge the distributing flap to the inner wall of the bowl.

Any number of valve capsules may be provided at the existing openings for the flushing water, such capsules being fed from a common storage container. The arrangement of the distributing flaps or valve capsules can be such that they are detachable, e.g. by means of clamp straps or suspension links, in which structure the distributing flaps and valve capsules are preferably mounted invisibly in the edge cavity of the bowl. In this structure the individual distributing flaps are preferably constructed in such a way that they are shaped according to the adjacent wall area of the bowl, so that they abut thereto at least in places.

The sponge supports may be kept wider toward the inner wall of the bowl than the distributing flap and may abut, at least in places, to the adjacent area of the inner wall of the bowl, and may be shaped to correspond to the shape of the bowl. Furthermore, the liquid absorbed by the sponge can be discharged, e.g. in the form of foam, not only above the sponge but also below it.

I claim:

1. Apparatus for disinfection and chemical purification of toilet bowls, comprising a storage container spaced from said bowl for a purifying and disinfecting liquid, and an automatically closing passage and outlet device which opens under the action of a flush flow, said passage and outlet device consisting of a valve capsule mounted in the cavity of the bowl edge near the water inlet opening of the bowl, said valve capsule being provided with a check valve and a flap actuated by the flush flow so as to open said check valve under the pressure of the flush flow, and fluid conveying means for feeding the disinfecting and purifying liquid to said valve capsule from said storage container.

2. The apparatus of claim 1 wherein said flap is provided with a holding and distributing surface for controlling the distribution of the water and liquid directed thereto.

3. The apparatus of claim 2, wherein said holding surface of the distributing flap for the distribution of the liquid is shaped, over a certain inside area of the bowl, so as to correspond to the wall shape of such area.

4. The apparatus of claim 2 wherein said flap, under the action of the flush water which is discharged into the bowl, assumes a prespecified inclination so as to hold, pass on and distribute the liquid flowing from the opened valve to said distributing flap.

5. The apparatus of claim 2 further characterized in that the surface of the distributing flap is formed with grooves so that the discharged flush water is atomized thereby promoting foam formation.

6. The apparatus of claim 1 wherein said distributing flap is provided with a surface which is inclined with respect to the wall of the bowl.

7. The apparatus of claim 1 wherein said distributing flap is provided with a sponge support for holding the liquid directed to said flap.

8. The apparatus of claim 7 wherein said sponge support is wider that the distributing flap and abuts, at least in places, the inner wall of the bowl.

9. The apparatus of claim 1 further including resilient clamp means for removably mounting said valve capsule and distributing flap within the edge cavity of the bowl.

10. The apparatus of claim 1, wherein said check valve is provided with two spaced valve cones facing in opposite directions, which, when the two terminal positions of the distributing flap are reached, alternatingly open and close the valve, in which process a prespecified amount of liquid is discharged upon the distributing flap, and spring means associated with said valve for automatically effecting return movement of the valve thereby terminating liquid discharge.

11. The apparatus of claim 10, wherein said distributing flap has positioned thereon a sponge layer which absorbs specific amount of liquid.by means of the return movement of the distributing flap when the flush flow ends and the distributing flap returns to its original position, so that the apparatus is ready to discharge liquid in a subsequent flush.

12. The apparatus of claim 1 wherein said flap is mounted for pivotal movement about a horizontal hinge means mounted on said valve capsule adjacent the bottom and at one side thereof, said check valve being mounted on said flap for seating on and unseating from an opening formed in the bottom of said capsule, and spring means for moving said valve into a seated position at the termination of the flush flow.

* * * * *